US006068563A

United States Patent [19]

Bengtsson

[11] Patent Number: 6,068,563

[45] **Date of Patent: *May 30, 2000**

[54] STICK FOR PLAYING WITH A PUCK OR A BALL

[75] Inventor: Kent Bengtsson, Örebro, Sweden

[73] Assignee: Orebroskenan Aktiebolag, Orebro, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/930,350

[22] PCT Filed: Apr. 2, 1996

[86] PCT No.: PCT/SE96/00432

§ 371 Date: Sep. 30, 1997

§ 102(e) Date: Sep. 30, 1997

[87] PCT Pub. No.: WO96/31259

PCT Pub. Date: Oct. 10, 1996

[51] Int. Cl.[7] ..... A63B 59/14

[52] U.S. Cl. ..... 473/562; 473/560

[58] Field of Search ..... 473/562, FOR 189, 473/560

[56] References Cited

U.S. PATENT DOCUMENTS 3,458,194 7/1969 Coles ..... 473/563

FOREIGN PATENT DOCUMENTS 1936088 5/1991 Australia .

273438 8/1927 Canada ..... 473/FOR 189

457235 12/1988 Sweden .

876414 8/1961 United Kingdom .

*Primary Examiner*—Mark S. Graham

*Attorney, Agent, or Firm*—Sughrue, Mion, Zinn, Macpeak & Seas, PLLC

[57] ABSTRACT

A stick for games that are played with a puck or a ball and in which the puck or ball is steered in a dribbling maneuver alternately with one and the other side of the stick blade (2). To this end, the blade is turned from side to side with the aid of the stick shaft (1), as when playing ice hockey, floor ball or some like game. The shaft (1) is joined to the blade (2) through the medium of a connecting part (9) which is so constructed that an extension of the longitudinal center axis (4) of the shaft will intersect the longitudinal center axis (7) of the blade at a point (11) between the toe part and the heel part (14; 12) of the blade. This point forms the rotational center of the blade (2) when executing said dribbling maneuvers.

7 Claims, 2 Drawing Sheets

STICK FOR PLAYING WITH A PUCK OR A BALL

BACKGROUND OF THE INVENTION

The present invention relates to a stick for games that are played with a puck or a ball, wherewith in a dribbling maneuver the player steers the puck or the ball alternately with one and the other side of the stick blade by repeatedly turning the blade from side to side with the aid of the stick shaft, as in ice hockey, floor ball and like games.

Although the invention is described in the following with reference to an ice hockey stick, it will be understood that the invention can also be applied equally as well to sticks used in other, similar games in which a puck or ball is used.

A typical ice hockey stick has a straight shaft and a blade which extends out from the bottom of the shaft, either straight or curved in the longitudinal direction. The blade can be considered as a growth from the shaft which is connected directly and rigidly with the heel of the blade. The blade heel is thus not able to spring in relation to the shaft. As a result of the intrinsic springiness of the blade, the toe of the blade can be flexed or bent laterally outwards in relation to the shaft when subjected to a laterally acting force. When subjected to a laterally acting force, the blade will skew relative to the shaft to a greater or lesser extent, depending where the force acts on the blade.

When the blade rotational centre, formed at the point of intersection between the longitudinal centre axis of the shaft and the longitudinal centre axis of the blade, is located in the heel of the blade, the blade will be turned about this rotational centre when carrying out a dribbling maneuver in which the blade is repeatedly turned from side to side. This means that the blade toe is forced to move around a relatively long circular arch whose radius corresponds to the full length of the blade. The movement is thus slow and requires a relatively pronounced arm movement. Because the blade is relatively long and because the shaft is joined to the heel of the blade, the force which the player is able to apply to the toe of the blade by turning the shaft is greatly reduced. This consequently reduces the strength with which the player can tackle for the puck in close-in tackling situations.

Players hold their sticks at different angles between the stick shaft and blade, depending on the style adopted by and the size of the player concerned. A player of large stature with an upright playing posture will use a smaller angle between shaft and blade, so that the blade will nct be positioned too far from his body. A shorter player who moves with a more crouched or hunched posture will normally use a larger angle between shaft and blade, so that the blade will not be too close to his body and to increase the stick range. In order to obtain a good overview of the game, a player should endeavour to adopt a playing style or posture that is as upright as possible.

GB-A-876,414 describes a golf club, primarily a putter, where the part of the shaft that connects with the blade is swung in an arch inwardly over the blade. This configuration has been employed to avoid twisting of the stick during a putting stroke, by distributing weight and balance so that the combined weight of the shaft and the part of the blade connected thereto, which lies on the side bordering the intersection line between the longitudinal axis of the shaft and the blade, is essentially the same as the weight of the remaining part of the blade.

A club of this kind is intended solely for impact with one surface of the blade and for impact at solely one single point.

It is not constructed for use in games in which the stick is used to dribble a puck or ball where both sides of the blade must be used. In the case of this type of stick, particularly when the stick shall be used as a putter, the shaft and the part of the blade joined thereto must be very rigid. A stick having a weight distribution in accordance with this patent cannot be used to play ice hockey for instance, since the front part of the blade would then need to be very strong or heavy, which would make the blade difficult to handle and greatly increase the weight of the stick as a whole.

FIG. 2 of publication AU-B-19360/88 illustrates a similar stick which is intended for use when playing field hockey and which has a lower part that is swung in over the blade. The stick can be brought to the position illustrated in FIG. 2 when striking the ball, which is effected in the same manner as when striking a golf ball. During play and when making rushes, the player inclines the stick downwards and holds the stick in one hand only and to one side, without turning the blade as when playing ice hockey. The main feature of interest with this type of stick is to strike the ball at an ideal point on the blade.

SUMMARY OF THE INVENTION

An object of the present invention is to provide a stick for games played with puck or ball with which dribbling and close-in tackling can be effected more easily and forcefully by enabling the stick blade to be turned or rotated more quickly and with smaller arm movements and by enabling the player to exert a greater force through the medium of the toe part of the stick blade.

Another object of the invention is to provide a stick which will enable a player to maintain a more upright posture during play.

Still another object of the invention is to provide a stick with which the entire blade can be flexed laterally outwards in relation to the longitudinal axis of the shaft when the blade is subjected to a force acting essentially perpendicularly to the impact surface when executing a shot, for instance.

The aforesaid objects are achieved with a stick of the kind defined in the first paragraph and characterized in that the shaft is connected to the blade through the medium of a connecting part which is so designed that an extension of the longitudinal centre axis of the shaft will intersect the longitudinal centre axis of the blade at a point located between the toe and the heel parts of the blade and forming the blade rotational centre in a dribbling maneuver.

The rotational centre of a stick constructed in accordance with the invention will thus be located somewhere in a centre part of the blade, wherein the toe part will be rotated in one direction and a heel part rotated in the opposite direction when turning the blade around this point. In this respect, respective blade parts need only move along a relatively short circular arc having a radius corresponding to half the length of the blade for instance, therewith enabling said movement to be executed more rapidly and with smaller arm movements than when using conventional sticks. The force that can be exerted by the player through the toe part of the blade by turning the shaft is also increased, since the lever arm between the point of rotation and the toe part is shortened.

The heel-shaft connecting part will conveniently include a straight portion which forms an angle with the longitudinal axis of the shaft and the blade and which connects the lower part of the shaft with the heel of said blade. In this regard, it is preferred that the straight portion of the connecting part slopes away from the blade. Among other things, such a construction enables the player to adopt a more upright posture during play, therewith enhancing the player's view of the rink, pitch or playing field.

The connecting part conveniently has a springiness or resilience which enables the entire blade to be flexed resiliently laterally outwards in relation to the longitudinal axis of the shaft when the blade is subjected to a force directed towards the rotational centre and acting at right angles to a blade side-surface. Among other things, this enables the force and the precision with which the puck is struck to be increased, since no appreciable skewing of the blade occurs, among other things. Such a construction also enables the heel part of the blade to flex resiliently outwardly in relation to the shaft.

BRIEF DESCRIPTION OF THE DRAWINGS

The invention will now be described in more detail with reference to exemplifying embodiments thereof and also with reference to the accompanying drawings, in which FIGS. 1 and 2 each illustrate a respective conventional type of ice hockey stick.

DETAILED DESCRIPTION OF THE PREFERRED EMBODIMENTS

Figure 1:
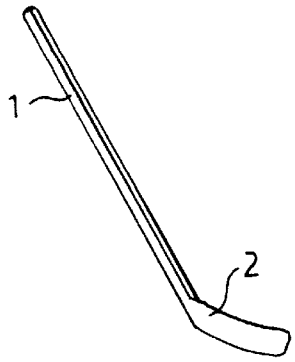

FIG. 1 illustrates a conventional ice hockey stick having a shaft 1 and a blade 2 projecting out therefrom. The blade is rigidly connected directly to the shaft. Among other things, this means that the heel part of the blade 2 is unable to spring or flex relative to the shaft, but can only be turned laterally together with said shaft.

Figure 2:
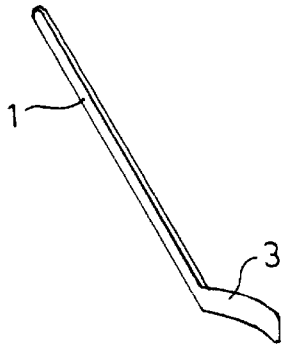

FIG. 2 illustrates a corresponding ice hockey stick with which the blade 3 is curved in its longitudinal direction. This blade enables the centrifugal force to be utilized to increase the speed of the puck at the moment of striking the puck. The blade and shaft relationship, however, is the same as that of the stick embodiment shown in FIG. 1.

Figure 3A:
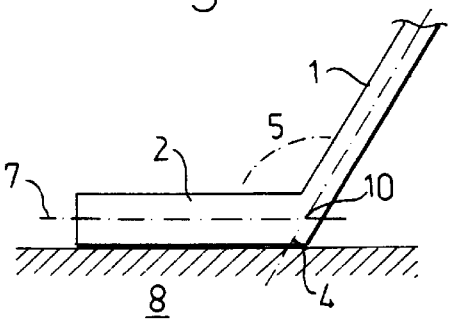
FIGS. 3A and B illustrate two different angles of the transition between blade and shaft with a stick illustrated in FIG. 1.
Figure 3B:
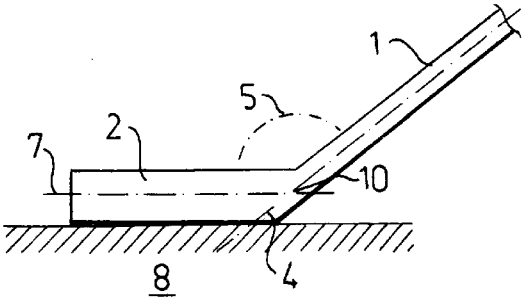

In conventional ice hockey sticks, the angle 5 (see FIGS. 3A and 3B) is adapted to the physical size and the playing style or posture of the player concerned, wherein the angle 5 between blade 2 and shaft 1 will be smaller when the stick is used by an upright player or a player of large physique (see FIG. 3A) so as to prevent the stick from becoming too long and too difficult to handle and to prevent the puck from being too far from the body. When the stick is used by a smaller player or a player adopting a more crouched playing attitude, the angle 5 between the stick blade 2 and the shaft 1 must be greater (see FIG. 3B) so as to prevent the stick from being too short, such that the blade will be located too close to the body and the range reduced.

Irrespective of the value of the angle 5, a longitudinal centre axis 4 in the shaft 1 will intersect a longitudinal centre axis 7 in the blade 2 at a point 10 in the lower part of the shaft or the heel part of the blade. This point represents a blade rotation point in dribbling maneuvers, in which the blade is repeatedly twisted or turned from side to side.

Figure 4:
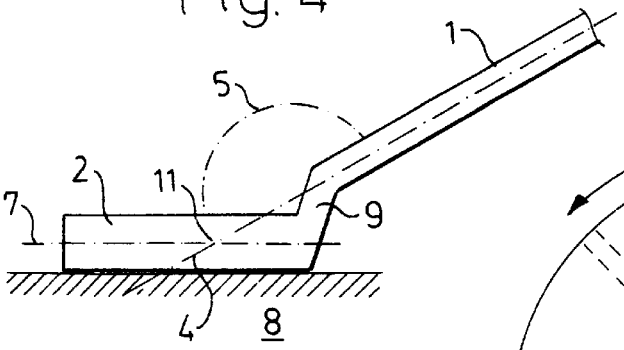
FIG. 4 illustrates a first embodiment of an inventive ice hockey stick.

FIG. 4 illustrates the lower part of an inventive ice hockey stick. In the case of this embodiment, the shaft 1 is joined to the blade 2 through the medium of an angled connecting part 9. This connecting part is designed so that the longitudinal centre line 4 of the shaft 1 intersects the longitudinal centre line 7 of the blade 2 at a point 11 located in a centre part of the blade 2. The blade rotational point has thus been moved forwardly in the blade in comparison with the case in conventional sticks according to FIG. 3. This displacement of the blade rotational centre to a central part of the blade provides a number of significant advantages in games that require dribbling maneuvers.

Figure 5:
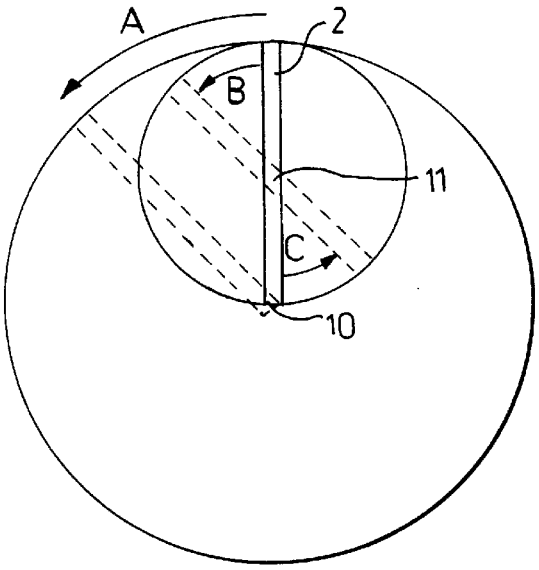
FIG. 5 illustrates the difference when turning the blade of a conventional ice hockey stick and when turning the blade of an inventive stick.

FIG. 5 illustrates schematically some of these maneuvers. As in the earlier Figures, the reference numeral 2 identifies the blade of an ice hockey stick, as seen from above. When using a conventional ice hockey stick (according to FIG. 3) to dribble a puck, the stick blade 2 will turn or twist around the point 10. This means that the toe part of the blade is forced to move along a relatively large circular arc A having a radius corresponding to the full length of the blade 2. This movement is relatively slow and requires the player to execute a large arm movement.

When the stick blade is turned or rotated about a point 11 instead, such as when using a stick provided with a connecting part 9 according to FIG. 4, the toe part of the stick will only move along a relatively short circular arc B having a radius corresponding to half the length of the blade when turning the blade 2 to a corresponding extent. This is achieved as a result of the heel part of the blade moving in an opposite direction along a circular arc C of corresponding length. Consequently, the blade of an inventive stick can be turned or rotated much more quickly than in the case of conventional sticks, which is highly significant during play.

As the rotational point of an inventive stick lies in a central part of the blade 2, the force that can be exerted by a player with the toe part of the blade, through the medium of the shaft 1, will be much greater than the force achievable with conventional sticks. This is because the lever arm between the rotational centre of the blade and its outer end is much shorter, about half the length of the corresponding lever arm of a conventional stick. This is highly significant when tackling close-in for the puck, player against player, and in face off situations.

Depending on the forces that act on the stick when the blade 2 makes contact with the playing surface, more specifically when the heel part or toe part of the blade is pressed against the playing surface as the stick moves sideways, the rotational point 11 will be moved either rearwardly or forwardly in the blade, but always within a limited central part thereof. This is due to the bending or flexing movement that therewith occurs in the connecting part 9 and in the blade, among other things.

Although the stick shown in FIG. 4 has a straight blade, it will be understood that the blade may be curved conventionally in its longitudinal direction, in the manner of the blade shown in FIG. 2.

Figure 6A:
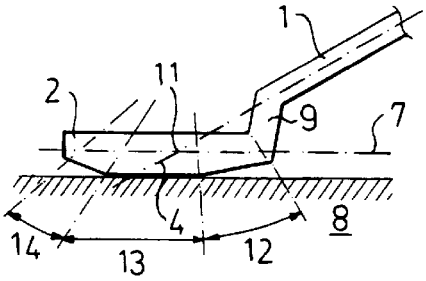
FIGS. 6A, B and C illustrate a second embodiment of an inventive ice hockey stick and show respectively the stick in three different angular positions.

The blade 2 of the embodiment of an inventive stick illustrated in FIGS. 6A, B and C has been divided into three parts, a heel part 12, a centre part 13 and a toe part 14. These parts are defined by differently angled portions of the bottom edge of the blade that is intended to make contact with the playing surface 8. The blade has a generally horizontal bottom edge in the centre part 13, i.e. the part within which the rotational point 11 can be displaced, whereas the parts adjacent hereto, i.e. the heel part 12 and the toe part 14 respectively, slope up towards respective ends of the blade 2. This ensures that a part of the bottom edge of the blade will always lie against the playing surface when the shaft 1 is inclined at angles normally occurring during play.

Figure 7:
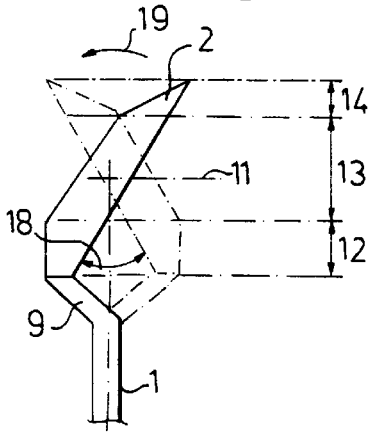
FIG. 7 illustrates the function of a stick according to FIG. 6 when performing a dribbling maneuver.

FIG. 7 illustrates a function of such a blade in those dribbling maneuvers that are performed by turning or rotating the shaft 1 around its longitudinal axis 4. It will be seen that the blade 2 is therewith rotated about the point 11, wherein the toe part 14 will move along an arc 19 in one direction and the heel part 12 will move along an arc 18 in the opposite direction with the direction of the shaft 1 remaining constant. This enables very rapid maneuvers to be made with the blade with wrist movements, which is a significant advantage in play.

Figure 6C:
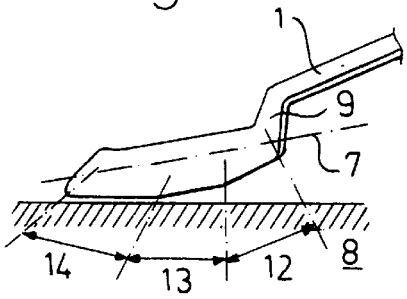
Figure 6B:
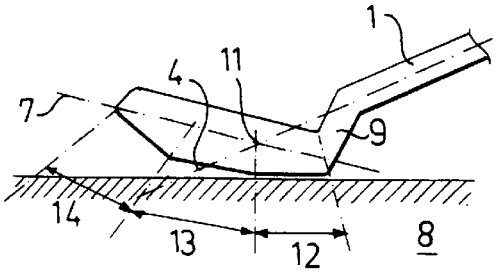

As an alternative to the angled sections of the FIG. 6 embodiment, the bottom edge of the blade 2 may be continuously rounded slightly to a desired shape.

When the stick includes a connecting part 9 between the shaft 1 and the blade 2, the player is able to adopt a more upright stance and therewith obtain a better overview of the game. Furthermore, a large and a short player that have the same playing style are able to use sticks that have the same angle 5 but different shaft lengths and optionally connecting parts 9 of different lengths.

The connecting part 9 of an inventive stick is able to spring when making a shot, i.e. to flex out laterally. This enables the entire blade to be flexed outwardly essentially uniformly when impact is made in the rotational point of the blade. The heel part can thus also be flexed laterally outwards in relation to the shaft. This has not been possible with conventional sticks, in which the heel part can only be flexed together with the shaft.

Figure 8:
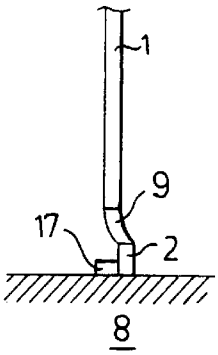
FIG. 8 illustrates schematically the function of an inventive stick when striking a puck.

FIG. 8 is a schematic front view of a shot on the puck 17 as the blade 2 makes contact with the puck, wherein the outward bending of the inventive stick has been exaggerated for the sake of clarity. The puck is thus struck sharply and with sting as a result of the catapult effect produced by the connecting part 9. The shot can herewith be achieved much more quickly and with a much shorter swing than was previously possible, making it difficult for an opponent to prepare himself to block the shot.

The springiness of the connecting part 9 is also used when making a so-called pull shot, i.e. a shot in which the stick blade is pressed against the ice adjacent the puck so as to bend the connecting part 9. As the bend straightens out, the puck is imparted a force supplement which increases the power of the shot and therewith the speed at which the puck travels.

Although the invention has been described in the aforegoing with reference to various embodiments of an ice hockey stick, it will be understood that the invention can also be applied with other types of sticks used in games that have essentially the same stick requirements as an ice hockey stick.

The embodiments illustrated in the accompanying drawings can also be modified in several respects within the scope of the Claims. For instance, the length, configuration and slope of the connecting part 9 can be varied in accordance with individual wishes. The same function as that described above can therewith also be achieved by connecting the shaft 1 to the toe part of the blade 2 through the medium of a connecting part or directly to the blade in its central portion.

What is claimed is:

1. An ice hockey stick in which a puck (17) is steered in a dribbling maneuver alternately with one and another, opposite side of an elongate blade (2) of the stick, by turning the blade repeatedly from side to side with the aid of a shaft (1) of the stick, said blade having a flat lower surface portion for engaging the ice, wherein the shaft is connected to the blade through a connecting part (9) which slopes away from the blade at an obtuse angle (5) and has a length substantially shorter than a length of both the shaft and the blade such that an extension of a longitudinal centre axis (4) of the shaft intersects a longitudinal centre axis (7) of the blade at a point (11) between a toe part (14) and a heel part (12) of said blade, said point forming a rotational centre of said blade when performing dribbling maneuvers, and wherein the connecting part has a sufficient resiliency or springiness to enable the blade to be flexed laterally outwards in relation to the longitudinal axis of the shaft when the blade is subjected to a force directed towards the rotational centre and perpendicular to the blade.

2. An ice hockey stick according to claim 1, wherein the connecting part includes a straight portion which forms an angle with the longitudinal axes of the shaft and the blade and connects a bottom part of the shaft with the heel part of said blade.

3. An ice hockey stick according to claim 1, wherein the resiliency of the connecting part enables the point of intersection between the longitudinal axes of the shaft (1) and the blade (2) to move forwards and rearwards in a centre portion (13) of the blade in response to forces acting on the toe part and the heel part, respectively of the blade.

4. An ice hockey stick according to claim 1, wherein the puck contact side of the blade lie essentially in mutually parallel and essentially vertical planes.

5. An ice hockey stick according to claim 1, wherein a blade edge surface may be adapted for contact with a playing surface (8) has a configuration such that a contact point or contact line with said playing surface can be displaced along the blade by varying an angle at which the shaft is inclined to the playing surface.

6. An ice hockey stick according to claim 5, wherein said edge surface has a generally horizontal centre portion bordered on both sides by a portion that slopes upwards towards respective blade ends.

7. An ice hockey stick according to claim 5, wherein said edge surface is arcuate between the ends of blade.

* * * * *